US008083095B2

(12) United States Patent
Hui

(10) Patent No.: US 8,083,095 B2
(45) Date of Patent: Dec. 27, 2011

(54) CONTAINER ASSEMBLY HAVING POSITIVE SNAP SEAL

(75) Inventor: Wang Hui, Ningbo (CN)

(73) Assignee: Shye Worldwide, LLC, (CA Ltd Liability Co.), Tustin, CA (US)

( * ) Notice: Subject to any disclaimer, the term of this patent is extended or adjusted under 35 U.S.C. 154(b) by 644 days.

(21) Appl. No.: 12/215,624

(22) Filed: Jun. 27, 2008

(65) Prior Publication Data

US 2009/0321462 A1 Dec. 31, 2009

(51) Int. Cl.
*B65D 39/00* (2006.01)
*B65D 51/16* (2006.01)

(52) U.S. Cl. ..... 220/789; 220/780; 220/790; 220/791; 220/367.1

(58) Field of Classification Search ..... 220/780, 220/659, 789–791, 801, 802, 367.1
See application file for complete search history.

(56) References Cited

U.S. PATENT DOCUMENTS 5,992,679 A * 11/1999 Porchia et al. ..... 220/782
7,063,231 B2 * 6/2006 Stanos et al. ..... 220/793
2007/0007298 A1 * 1/2007 Tucker et al. ..... 220/791

* cited by examiner

*Primary Examiner* — Robin Hylton
(74) *Attorney, Agent, or Firm* — Curtis L. Harrington; Harrington & Harrington

(57) ABSTRACT

An easily closable and open able container system includes a number of features which facilitate easy opening and closing while maintaining a high seal, which will give a feedback to the user to let the user know that a seal is formed. A circumferentially inwardly disposed angled groove is formed on the inside the opening of a container. A complementary angled projection is formed on the circumferentially outwardly disposed surface of the lid for fitting into the circumferentially inwardly disposed angled groove formed on the inside the opening of a container.

8 Claims, 2 Drawing Sheets

CONTAINER ASSEMBLY HAVING POSITIVE SNAP SEAL

FIELD OF THE INVENTION

The present invention relates to a number of advantageous structures and devices for safe, convenient, easy to open and close containment sealing systems which are ideal for preserved sealing, particularly for foodstuffs.

BACKGROUND OF THE INVENTION

Sealed containers are typically used in conjunction with food and other materials to be protected from moisture and the environment, or used with liquids and are to be isolated from spillage. Most sealed containers commercially available have compromised the sealing engagement in order to facilitate a snap shut closure. Quick engagement structures don't typically produce as strong of a seal as a more extended seal with significant sealing forces. Conversely, a good seal typically involves a complex locking arrangement or an extended seal. However, most complex locking arrangements or extended high pressure seals are inconsistent with ease of use and low expense.

The need for an efficient and easily operable seal is especially needed with respect to food containers which may be subjected to microwave use. The failure to form a lid hugging seal can cause containers holding the heated food to explode in the microwave causing damage and a mess. The instant container includes a superior seal as well as a pressure relief valve to that it can be employed to maximum effect in a microwave to insure that the lid stays on. If the pressure exceeds the pressure rating of the safety/pop valve assembly, which will typically be far less than the pressure necessary to dislodge the sealed lid, the safety/pop valve assembly will open to enable gaseous pressure to subside.

Sealing systems and container systems with secure seals can create significant problems for users. Where the seal is good, the use of the container may be accompanied by difficulty in sealing, requiring significant strength by the user. Where the seal is strong, removing the lid can cause the user to use two hands where the lid has significant holding force onto the container. This can cause spillage and mess on either opening or closing. Causing a user to press down hard can either trip a vapor relief valve, if present, or it can cause pressure discharged ejection of material between the lid and container before sealing occurs. On opening, any lifting beyond simple breaking of the seal by lifting the corner can result in a container which is so frictionally engaged with the lid that lifting of the lid simply lifts the lid and container while in partially opened condition, to then cause spillage.

One of the difficulties in sealing a container is knowing when it is sealed. Many commercially available containers have lids which are pressed onto containers, but don't indicate when sealing has occurred. This causes a user to over press and potentially squeeze out contents before sealing, or it causes the user to have to stop what they are doing and focus full attention on the evenness of the attached lid as an indication of sealing. Most commercially available sealing systems are so friction laden that there is little or no indication that full sealing has occurred without close inspection. Nearly everyone has experienced spillage from a container which was not closely inspected and visually tested before use or storage.

What is needed is a sealing system which provides ease of engagement on sealing accompanied by some quick and easy indication of sealing. An indication which indicates sealing and which does not require close inspection is needed. An indication which assures of good sealing other than visual and which triggers another of the users senses would be most helpful. What is also needed is a system which facilitates quick unsealing in a way in which the lid does not cling to the container so that it can only be removed by a peeling and gross force separation action. The needed system will facilitate reliability in sealing and unsealing which will reduce spillage and lack of sealing.

SUMMARY OF THE INVENTION

An easily closable and open able container system includes a number of features which facilitate easy opening and closing while maintaining a high seal, and especially which will give a feedback to the user to let the user know that a seal is formed. A circumferentially inwardly disposed angled groove is formed on the inside the opening of a container. A complementary angled projection is formed on the circumferentially outwardly disposed surface of the lid for fitting into the circumferentially inwardly disposed angled groove formed on the inside the opening of a container.

With respect to the inside of the container and leading to the outside, in a preferred embodiment, any material on the inside of the container which would otherwise escape first encounters the angled projection/angled groove interlocking snap seal. It would be difficult for any material to make it past the angled projection/angled groove interlocking snap seal, but if any material were under high pressure and did manage to get past the seal, further downwardly curved lip seal presents a significant area of material between which any such material must pass, with difficulty to escape to the surrounding environment.

The angled projection/angled groove engages with a "snap" both in movement and sound and keeps the further downwardly curved lip seal in close and closed proximity. The opening of the container is made easy by use of a corner lip, as well as the angled projection/angled groove which, once decoupled at any point along its length, simple lifting rigidly and controllably decouples the two sides adjacent to the lift tab and the lid lifts off quickly.

Further, because the angled projection is on a part of the lid which extends circumferentially outward and because the angled groove is located circumferentially inward the sealing is facilitated by simply pressing down upon the lid. The downwardly directed "U" shaped relationship between the lid and the container is oriented to control and further lock the angled projection toward the angled groove and contributes to the smart "snap" upon closing. The downwardly directed "U" shape has sides which are angled and thus apply the maximum force on the angled projection/angled groove at the position of closure. The sides of the "U" shape are angled, having an angular displacement of from about five degrees to about ten degrees and more preferably from about seven to about eight degrees. If the sides of the "U" shape were parallel, there would be friction resistance to closing over a longer distance and the innermost extent of the angled projection might experience undue wear over the longer length of travel under bearing force. By angling the sides of the "U" shape, the angled projection will not be under a bearing force until the moment just before sealing. The same is true for unsealing, where disengagement of the angled projection is followed by a release of the pressure urging it toward the wall of the container containing the angled groove.

The extended length of the outside of the "U" shaped angled member (which appears as an arm or projection in side section) provides a more gentle spring action against the spring action of the outside of the complementary "U" shaped angled member (which appears as an arm or projection in side section) of the lid. As a result, the initial bringing together of the lid and container make for a simple, low resistance guided engagement terminating in a solid snap seal. In the reverse operation, the lid and container are rapidly separable. This is important as the force manually applied to a container upon closing or opening should not be so high as to increase the chances of spillage. On closure, the container and lid are already in position with low force at the time of snap sealing. On opening, the most significant force is applied at the corner to break the initial seal. The lifting force which removes the lid requires very little force. This is unlike conventional containers with conventional sealing systems in which the lid can cling to the container even after the seal is broken at the corners and even though the lid is up to a quarter to one half to three quarters open.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
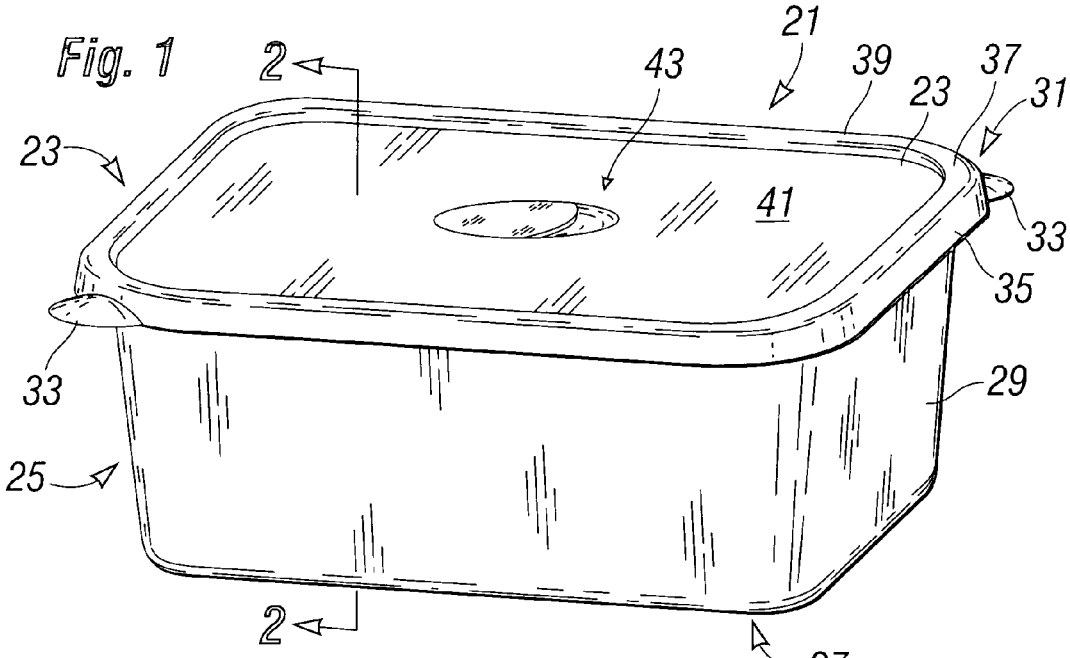
FIG. 1 illustrates a perspective view of a rectangular container with a lid in place and illustrating the extended lip, pop valve and top configuration.

The description, construction and operation of the sealing system of the invention will be best illustrated by beginning with reference to FIG. 1, which illustrates a perspective view of a rectangular oblong container 21 including a lid 23 and a base container 25 having a bottom 27 and a generally continuous side wall 29. The base container 25 is typically injection molded as a single piece, as is the lid 23. The lid 23 is seen as having a rim 31 which may include a lift tab 33 extending at a corner and from an outer downwardly extending rim portion 35 which may be continuous with an oval, curved or flat middle rim portion 37, and which may depend from an inner downwardly extending (extending downwardly with respect to the middle rim portion 37, but upwardly with respect to the lid main expanse 41) rim portion 39 which may in turn be continuous with a lid main expanse 41. Outer downwardly extending rim portion 35, flat middle rim portion 37, and inner downwardly extending rim portion 39 may be collectively referred to as members 35, 37, and 39. A relief valve assembly 43 is also seen.

Figure 2:
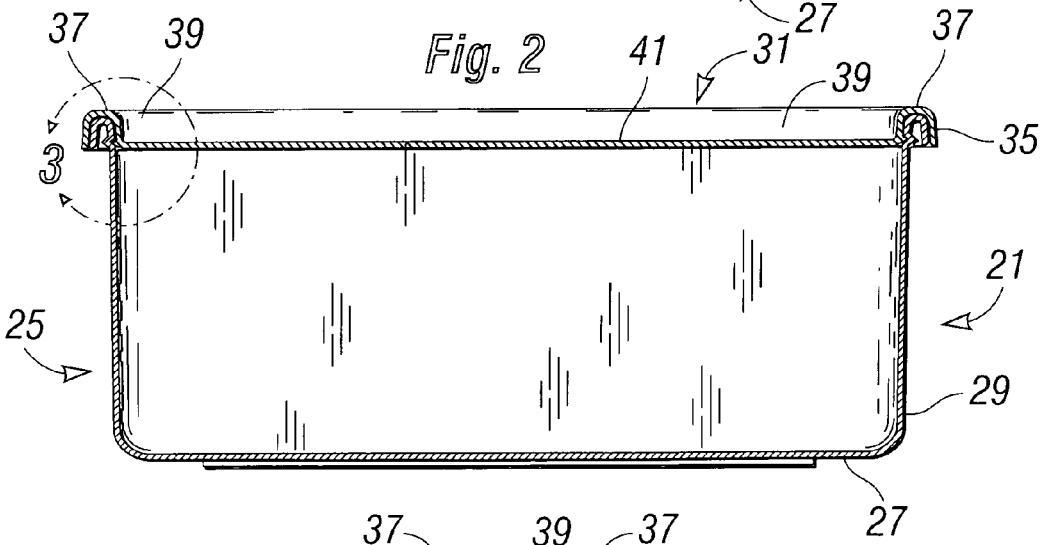
FIG. 2 is a sectional view taken along line 2-2 of FIG. 1 and illustrates further details of the container and lid and the general method of fit.

Referring to FIG. 2, a sectional view taken along line 2-2 of FIG. 1 is seen and illustrates further details of the container and lid and the general method of fit, as well as the wall thickness of the container. All of the numbered structures seen in FIG. 1 are also seen in FIG. 2, but a discussion of the details of the seal will be discussed with respect to FIG. 3 for clarity.

Figure 3:
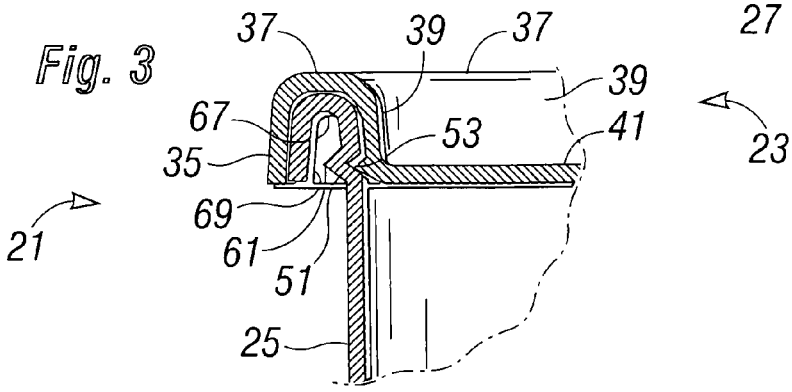
FIG. 3 illustrates an expanded sectional view along line 3-3 of FIG. 2 which shows the cross section in a seated position.

Referring to FIG. 3, an expanded sectional view along line 3-3 of FIG. 2 which shows the cross section seen in FIG. 2 in a seated position. As can be seen, the outer downwardly extending rim portion 35, middle rim portion 37, and inner downwardly extending rim portion 39 of the lid 24 form an inverted "U" cross-sectional shape. At the inside lower portion of the inner downwardly extending rim portion 39 has a circumferentially outwardly disposed projection 51. The base container 25 wall 29 extends upwardly and forms a corresponding groove 53 which interfits with and accommodates the circumferentially outwardly disposed projection 51. The opposite side of the base 25 wall 29 has an accommodating raised portion 61 which may or may not be present on any given sealing system, as will be explained.

Beginning just below the groove 53, base container 25 includes a number of wall features which start with the groove 53, and include an inner wall 65, leading to a top wall 67 and then to an outer downwardly extending wall 69. Inner wall 65, top wall 67 and outer downwardly extending wall 69 may be referred to in the collective as members 65, 67, and 69. As will be shown, members 65, 67 and 69 form an extended seal with respect to members 35, 37, and 39. Further, the circumferentially outwardly disposed projection 51 projects as a right angle to the extended seal which will be formed with respect to the members 65, 67 and 69 and members 35, 37, and 39. The geometry is such that the lateral holding force of the circumferentially outwardly disposed projection 51 actually reinforces the sealing pressure of the resulting extended seal which will be formed with respect to the members 65, 67 and 69 and members 35, 37, and 39. As will further be shown, the outer downwardly extending wall 69 has the ability to flex away from and toward the inner wall 65. Further, the outer downwardly extending rim portion 35 of the lid 23 has the ability to flex away from and toward the inner downwardly extending rim portion 39.

The previously mentioned, the accommodating raised portion 61 may exist due to the need to effectively form the groove 53 as a part of the manufacturing process. Further, material forming the raised portion 61 may be present in order to insure that the structural integrity of the portion of the base container 25 wall 29 extending upwardly above the lowermost beginnings of the groove 53 has sufficient structural integrity to support the material of the container 25 wall 29 around the groove 53, inner wall 65, top wall 67 and outer downwardly extending wall 69. However, it can be seen that raised portion 61 is closest to the inside of the and outer downwardly extending wall 69, such that it can form an effective limit of any flexing of the and outer downwardly extending wall 69 toward the raised portion 61 and of the outer downwardly extending wall 69 toward the main extent of the base container 25 generally. As a result this demonstrates that the thickness of the base wall material 25 as well as the raised portion 61 can held to provide a limit on the hairpin (from a cross sectional view) flexibility of the extreme most portions of the base 25.

Note that the cross sectional profile of the circumferentially outwardly disposed projection 51 shows it to have a triangular projecting shape with the upper and lower angled surfaces having an angle which may be sharply defined. The angle shown is about eighty to about ninety degrees with a preferred angle of about eighty-three degrees. In FIG. 3 and following, the upper and lower angles, of the circumferentially outwardly disposed projection 51, rise from the exterior of the base container 25 wall 29 at about the same angle. An eighty four degree projection with equal sides and a center which is generally perpendicular has a rise from the base container 25 wall 29 of about forty-eight degrees. It is clear that the upper and lower angle of the circumferentially outwardly disposed projection 51 can be adjusted to give more sealing force and opening resistance with an easier closing by having a lower angle, of the circumferentially outwardly disposed projection 51, with respect base container 25 less than the upper angle of the circumferentially outwardly disposed projection 51.

However, using a circumferentially outwardly disposed projection 51 with a sharply angled upper and lower surfaces will enable them to seat within a corresponding sharply angled groove 53 with a sharp snap action. Further, the sharply angles and well defined interfitting will give, depending upon the materials used, a sharply defined "zip" alignment. A more rigid material will exhibit more zip synergy, while a softer material will exhibit a slower, more relaxed zip. Where a linear length of wall having a sharp projection is located adjacent a similar length of wall having a sharp groove any near alignment, along with some urging pressure of one toward the other will result in a rapid capturing alignment. As will be shown, this is but one part of the mechanism of the seal system of the invention which acts to rapidly lock the seal interaction during engagement and to rapidly unlock it during opening.

Figure 4:
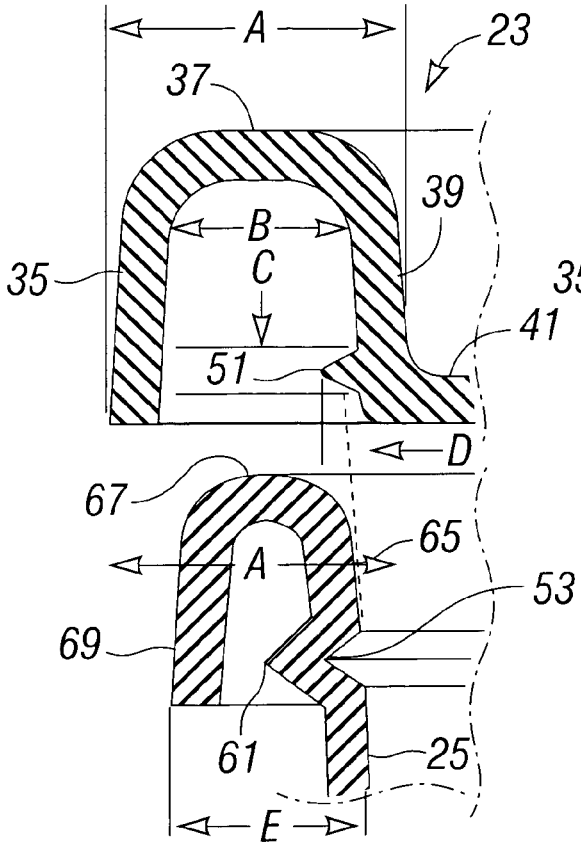
FIG. 4 is a much expanded and separated view of the lid and container as seen in FIG. 3 and centering further still on the cross sectional components of the container base sealing structures and container lid sealing structures, and shown with dimensional and angular indications.

Referring to FIG. 4, a greatly expanded and separated view of the lid 21 and container base 25 as seen in FIG. 3 and centering further still on the cross sectional components of the container base sealing structures and container lid sealing structures is seen. The structures are shown with dimensional and angular indications which facilitate a discussion of the dimensions. The dimension "A" is the cross sectional width of the outside dimension of the sealing part of the lid 23 (including the outside of outer downwardly extending rim portion 35, middle rim portion 37, and inner downwardly extending rim portion 39) and may be about 1.0 to about 1.2 centimeters for a container 21 having dimensions appropriate for refrigerator food storage. The height dimension "B" may also be from about 1.0 to about 1.2 centimeters.

Dimension "C" is the base of the circumferentially outwardly disposed projection 51 as it extends from the wall of inner downwardly extending rim portion 39 which faces outer downwardly extending rim portion 35. Dimension "C" is from about 0.12 to about 0.17 centimeters and may preferably be about 0.14 centimeters. Dimension "D" is the lateral protrusion length of the circumferentially outwardly disposed projection 51 above the wall of inner downwardly extending rim portion 39 which faces outer downwardly extending rim portion 35. Dimension "D" is from about 0.06 to about 0.11 centimeters and may preferably be about 0.08 centimeters. The magnitude of depth and width of the groove 53 should either match exactly or be slightly larger than the width and depth of the circumferentially outwardly disposed projection 51 so that the circumferentially outwardly disposed projection 51 can be easily accommodated and urged to the center of the groove 53.

As will be shown, both of the structures seen in FIG. 4 can flex to accommodate each other. Further, note that outer downwardly extending rim portion 35 forms a shallow angle gamma (Γ) with respect to with respect to inner downwardly extending rim portion 39 of from about five degrees to about ten degrees and more preferably from about seven to about eight degrees. Similarly, the same general angular relationship is had between the inner wall 65 and the outer downwardly extending wall 69 of the base container 25 to the extent that these structures will be able to fit within the combination of the outer downwardly extending rim portion 35, middle rim portion 37 and inner downwardly extending rim portion 39.

Dimension "E" is the lateral width between a base of the an inner wall 65 opposite a base of the outer downwardly extending wall 69. Dimension "E" is from about 0.5 to about 0.7 centimeters and may preferably be about 0.6 centimeters. Note that the shape of the exterior of the combination of the inner wall 65, top wall 67, and outer downwardly extending wall 69, should preferably match the inside of the combination of the outer downwardly extending rim portion 35, middle rim portion 37 and inner downwardly extending rim portion 39, to form a good interfit when brought into a mating position.

Figure 5:
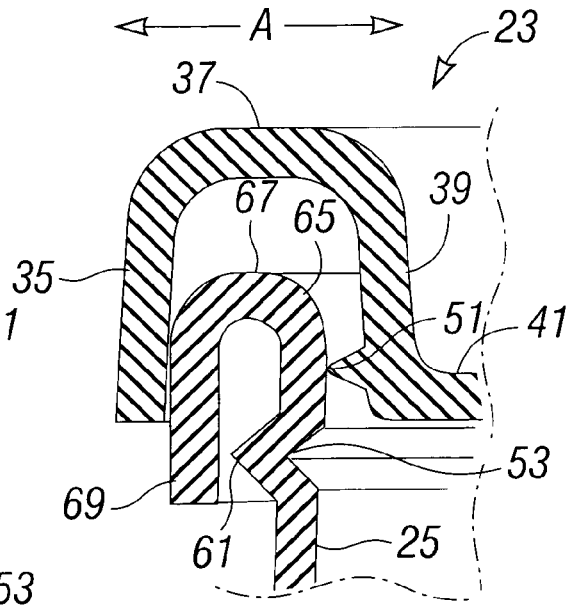
FIG. 5 is a view of the much expanded and separated view of the lid and container as seen in FIG. 4 but illustrating the opening expansion of structure in the lid sealing structure to accommodate the base sealing structure, as well as the compression of the base sealing structure in response to the expansion of the lid sealing structure, and shown as a point during engagement or disengagement at the halfway point and before the angled projection/angled groove interlocking snap seal has been fully engaged.

Referring to FIG. 5, a view of the much expanded and separated view of the lid and container as seen in FIG. 4 but illustrating an urged expansion of the outer downwardly extending rim portion 35, middle rim portion 37, and inner downwardly extending rim portion 39 as the structures including the an inner wall 65, top wall 67 and outer downwardly extending wall 69 are inserted upwardly. Note also that this movement causes the an inner wall 65 to somewhat collapse toward the inner wall 65 and may touch accommodating raised portion 61 when it is present.

This double springing action combines the resiliency of the materials to come together to make an extended seal between the members 35, 37 & 39 and the members 65,67 and 69. Further, note that because of the angle Γ, that the entry of the top portion of the members 65,67 and 69 are presented with a relatively wide bottom portion of the members 35, 37 & 39 for easy entry and a facilitated alignment. Even the circumferentially outwardly disposed projection 51 makes no significant blockage of the members 65, 67 and 69 into the underside of the members 35, 37 & 39 because of the angularity between members 35 & 39.

The position shown in FIG. 5 is the point at which some open flexing of the members 35, 37 & 39 begins. The contact of the circumferentially outwardly disposed projection 51 with the outer wall of member 65 is very brief and occurs only just before the circumferentially outwardly disposed projection 51 has an opportunity to quickly enter the groove 53. This is the source of the snap. As soon as the tip of circumferentially outwardly disposed projection 51 is moved to a point slightly inside the outer edge of the angled groove 53, the force of the members 65,67 and 69 resisting opening movement (seeking to close) and the force of the members 65,67 and 69 resisting a closing, collapsing movement (and seeking to open or expand) rapidly seats the circumferentially outwardly disposed projection 51 into the groove 53 as the seating action further forces the members 65,67 and 69 against the members 35, 37 & 39. In essence, the interaction between the outwardly disposed projection 51 and the groove 53, along with the springing force built up between the members 65,67 and 69 against the members 35, 37 & 39 produces a direct seal between the outwardly disposed projection 51 and the groove 53, while producing a direct seal between the members 65,67 and 69 and members 35, 37 & 39 by shoving the members 65,67 and 69 against the inside of the members 35, 37 & 39 to produce an extended interstitial seal. This extended interstitial seal extends between the base of the outwardly disposed projection 51 and the groove 53 and the lower terminating extents of the outer downwardly extending rim portion 35 and outer downwardly extending wall 69.

Figure 6:
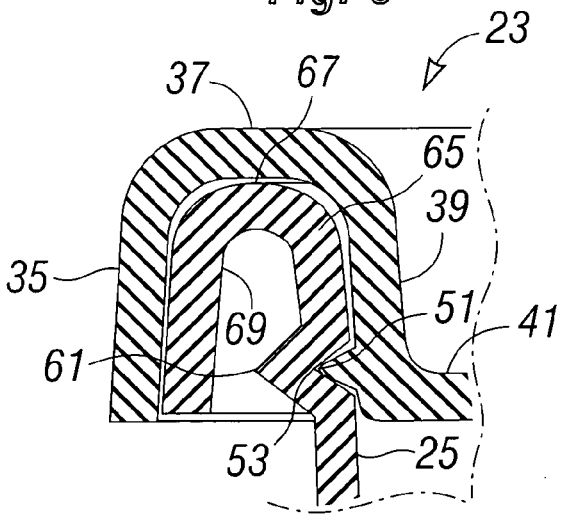
FIG. 6 is a view of the much expanded and separated view of the lid and container as seen in FIGS. 4 and 5 but shown in completely engaged position as seen in FIG. 3, but in an expanded view to illustrate that the structures associated with the lid sealing structure have returned to a position substantially as seen in FIG. 4 while the structures associated with the base sealing structure have similarly returned to a position substantially as seen in FIG. 4 with these structures being urged to remain in sealing position.

Due to the geometry of the structure seen in FIGS. 4-6, the sealing forces are developed over a short length of travel of the members 65,67 and 69 into the inside of the members 35, 37 & 39. This abbreviated action also contributes to disengagement of the lid 23 with respect to the base container 25.

Referring to FIG. 6, a view of the much expanded and separated view of the lid 23 and container base 25 as seen in FIGS. 4 and 5 is seen. The members 65,67 and 69 are shown completely seated into the inside of the members 35, 37 & 39. It should be noted that these sets of members can be pre-stressed to produce a higher force between them in the position seen in FIG. 6, but this may or may not be necessary. Depending upon the materials chosen for the lid 23 and the base container, such pre-stressing may result in a closer position of outer downwardly extending rim portion 35 to inner downwardly extending rim portion 39, and a more separated position of outer downwardly extending wall 69 with respect to inner wall 65 and base container 25.

When the last of the continuous circumferentially outwardly disposed projection 51 is moved over the complementary groove 53, the result will be an audible "snap" sound to indicate the container 21 is sealed. This eliminates the need for the user to closely inspect the lid 23 with respect to the base container 25 to insure that sealed closure has occurred. Further, the continuous circumferentially outwardly disposed projection 51 seals with the groove 53 and also acts to help secure the extended seal formed with respect to members 35, 37, and 39, and members 65, 67 and 69. In the opening operation, the same synergy which creates the "snap" final seal and which exploits the mutually reinforcing relationship where the projection 51 and groove 53 seal acts to secure and reinforce the extended seal of members 35, 37, and 39, with respect to the members 65, 67 and 69, assists the user in separating the lid 23 from the base container 25.

While the present invention has been described in terms of a system and method for providing synergistic seal which provides for ease of force application on sealing to form both a projection and groove seal lateral to an extended surface area seal, one skilled in the art will realize that the structure and techniques of the present invention can be applied to many structures, including any structure or technique where an efficient sealing is to be had with a container lid and base and which is stable, easy to use and can be operated with less force and more sealing.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A sealable container comprising:

a base container having a bottom and a wall which includes a circumferentially inwardly directed groove, an inner wall, a top wall and an outer downwardly wherein said inner wall, top wall and outer downwardly extending wall form a container rim;

a lid having a main planar extent, an upwardly extending inner rim portion, a middle rim portion and an outer downwardly extending rim portion, a circumferentially outwardly disposed projection adjacent a wall of the inner rim portion and extending in a direction of the outer downwardly extending rim portion and complementary to the groove of the base wall and wherein said projection is at least partially within a plane of said main planar extent of said lid.

2. The sealable container as recited in claim 1 and wherein said inner wall is angled with respect to said outer downwardly extending wall.

3. The sealable container as recited in claim 2 wherein the angle of said inner wall with respect to said outer downwardly extending wall is from about five to about ten degrees.

4. The sealable container as recited in claim 1 and wherein said upwardly extending inner rim portion is angled with respect to said outer downwardly extending rim portion.

5. The sealable container as recited in claim 4 wherein the angle of said upwardly extending inner rim portion with respect to said outer downwardly extending rim portion is from about five to about ten degrees.

6. The sealable container as recited in claim 4 wherein said circumferentially outwardly disposed projection of said lid has a pair of oppositely disposed angled surfaces having an angle of from about eighty to about ninety degrees with respect to each other.

7. The sealable container as recited in claim 6 wherein said pair of oppositely disposed angled surfaces meet at a common edge.

8. The sealable container as recited in claim 1 wherein said inner wall, a top wall and an outer downwardly extending wall, form an extended seal with respect to said inner rim portion, said middle rim portion and said outer downwardly extending rim portion when said lid is attached to said base container.

* * * * *